United States Patent [19]

Call

[11] 4,050,218

[45] Sept. 27, 1977

[54] COIN ROLL PACKAGING SYSTEM

[75] Inventor: Daniel D. Call, Sarona, Wis.

[73] Assignee: Cummins-Allison Corporation, Glenview, Ill.

[21] Appl. No.: 643,368

[22] Filed: Dec. 22, 1975

[51] Int. Cl.[2] ..... B65B 5/10

[52] U.S. Cl. ..... 53/167; 53/244

[58] Field of Search ..... 53/59 R, 167, 244, 245, 53/246, 236, 263; 198/22 R, 198

[56] References Cited

U.S. PATENT DOCUMENTS

| | | | |
|---|---|---|---|
| 3,346,093 | 10/1967 | Sjoberg | 198/22 |
| 3,611,672 | 10/1971 | Pilat | 53/59 R |
| 3,842,573 | 1/1973 | Price | 53/244 X |
| 3,866,388 | 2/1975 | Koehler | 53/59 R |

*Primary Examiner*—Robert Louis Spruill

*Attorney, Agent, or Firm*—Leydig, Voit, Osann, Mayer & Holt, Ltd.

[57] ABSTRACT

An automatic packaging system for coin rolls which includes a conveyor for receiving coin rolls from a plurality of wrapping machines and transporting the rolls in seriatim in the direction of the axes of the rolls. The conveyor comprises a driven continuous belt which is inclined transversely to its direction of movement, with a continuous guide rail cooperating with the lower portion of the belt to form a generally V-shaped track along which the coin rolls are conveyed by the driven belt, with the V shape of the track bringing the coin rolls into axial alignment with each other. The guide rail forms at least one coin slot for discharging any loose coins that fall onto the track. The conveyor includes a first belt which is driven at a fast speed, a second belt which is driven at a slow speed to accumulate the coin rolls in closely spaced relation to each other, and a third belt which is driven at a fast speed to space the rolls farther apart again at uniform intervals. From the third belt the rolls are transferred to a lift mechanism which elevates the rolls to an upper conveyor. From the lift mechanism the coin rolls are transferred to an upper conveyor which also includes a driven belt and a guide rail forming a V-shaped track. As the coin rolls are transported along the upper conveyor they are loaded by gravity into packaging forms at a plurality of packaging stations. The packaging form and the upper conveyor are also designed so that the last roll loaded into any given form serves to shunt all succeeding rolls to the next packaging station.

19 Claims, 22 Drawing Figures

COIN ROLL PACKAGING SYSTEM

DESCRIPTION OF THE INVENTION

The present invention relates generally to the systems for packaging coins rolls and, more particularly, to systems for automatically packaging coin roll as they are discharged from one or more wrapping machines that form the rolls.

It is a primary object of the present invention to provide an improved system for automatically packaging coin rolls at substantially higher production rates than previously known systems.

It is another object of the invention to provide such an improved system for automatically packaging coin rolls which operates with a high degree of reliability in the handling of the coin rolls.

It is a further object of the invention to provide such an improved system for automatically packaging coin rolls which facilitates removal of completed packages from the system by the human operator.

Another object of the invention is to provide such an improved system for automatically packaging coin rolls which improves the packing of the coin rolls in the containers. In this connection, a related object of the invention is to provide such a system which can be used to pack the rolls in either bags or boxes.

A still further object of the invention is to provide such an improved system for automatically packaging coin rolls which can be efficiently manufactured at a relatively low cost in comparison to previously known coin roll packaging systems.

Yet another object of the invention is to provide such an improved system for automatically packaging coin rolls which facilitates the collection of loose coins that generally drop onto the packaging system due to the breakage of rolls in the wrapping operation, for example. In this connection, a related object of the invention is to provide such a system which virtually eliminates any possibility of roll breakage in the packaging system itself, and which effectively prevents the transport of loose coins along with the coin rolls through the packaging system.

It is still another object of the invention to provide such an improved system for automatically packaging coin rolls which minimizes the application of mechanical forces to the coin rolls to transport and pack them, thereby reducing the possibilities of jamming, roll breakage and the like. Thus, one specific object of the invention is to provide such a system which utilizes gravity and the cylindrical shape of the rolls to transport the rolls wherever possible.

Other objects and advantages of the invention will be apparent from the following detailed description and the accompanying drawings, in which.

Figure 13:
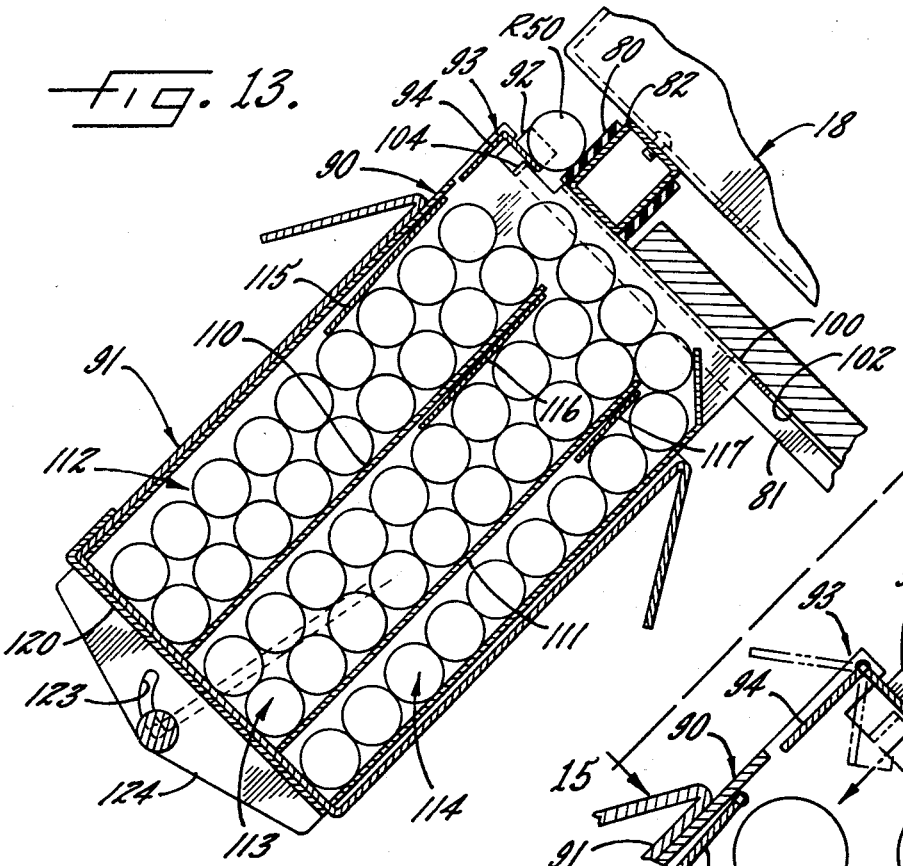
FIG. 13 is an enlarged section taken along line 13—13 in FIG. 10.
Figure 14A:
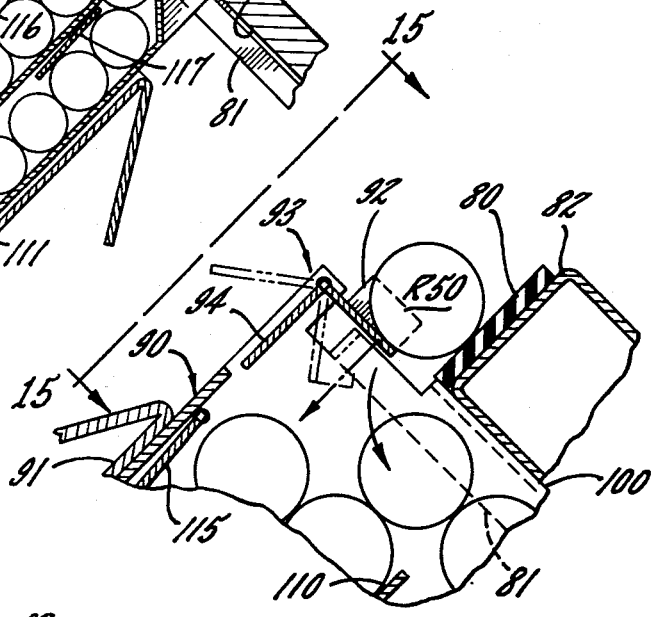
Figure 14B:
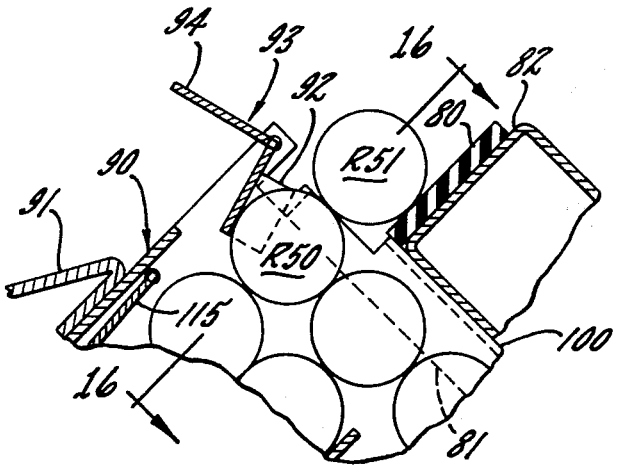
Figure 14C:
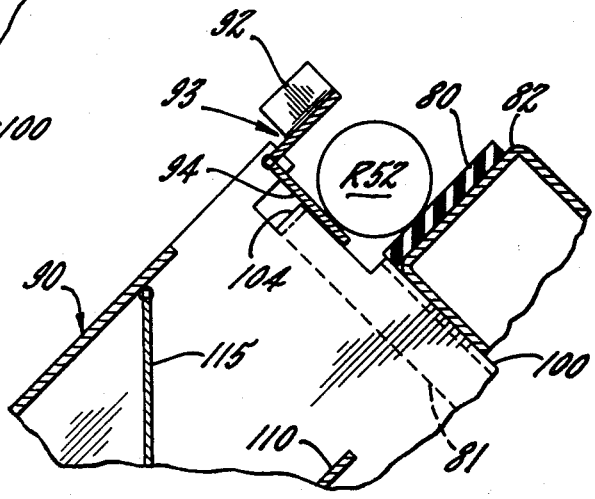
Figure 15:
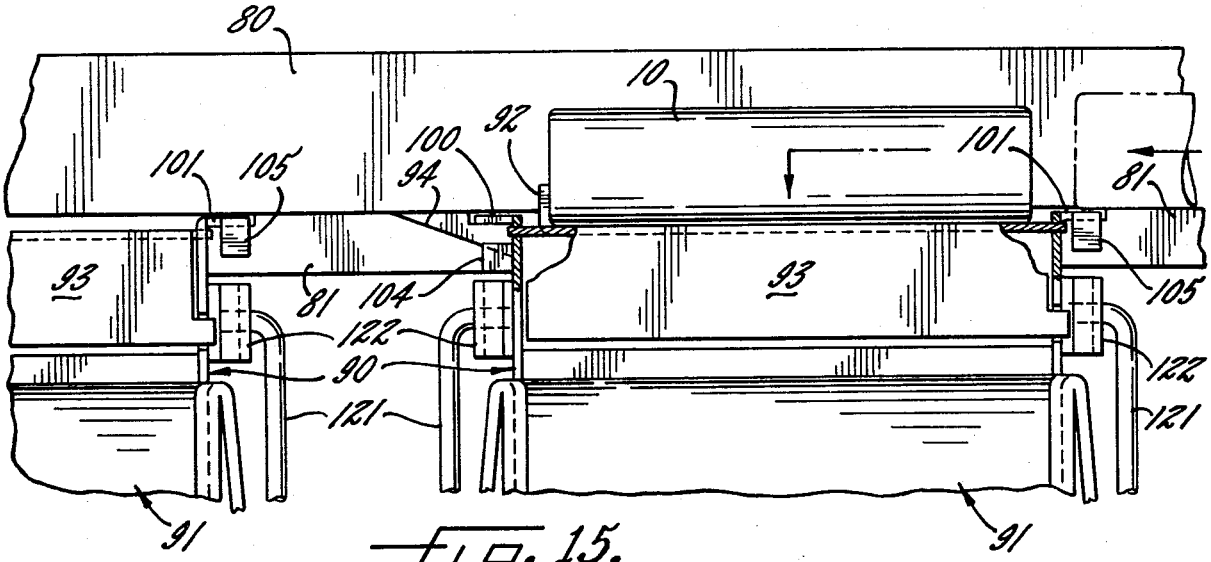

FIG. 14*a* is an enlarged view of the upper right-hand corner of the packaging form shown in FIG. 13 with the last of 50 coin rolls about to enter the packaging form;

FIG. 14*b* is the same view shown in FIG. 14*a* but with the last coin roll already in the form and illustrating the next coin roll bypassing the filled station;

FIG. 14*c* is the same fragmentary perspective view shown in FIG. 14*a* with the form completely empty and with the entry gate in a position to cause the coin rolls to bypass that particular station;

FIG. 15 is a plan view taken along line 15—15 in FIG. 14*a;*

Figure 16:
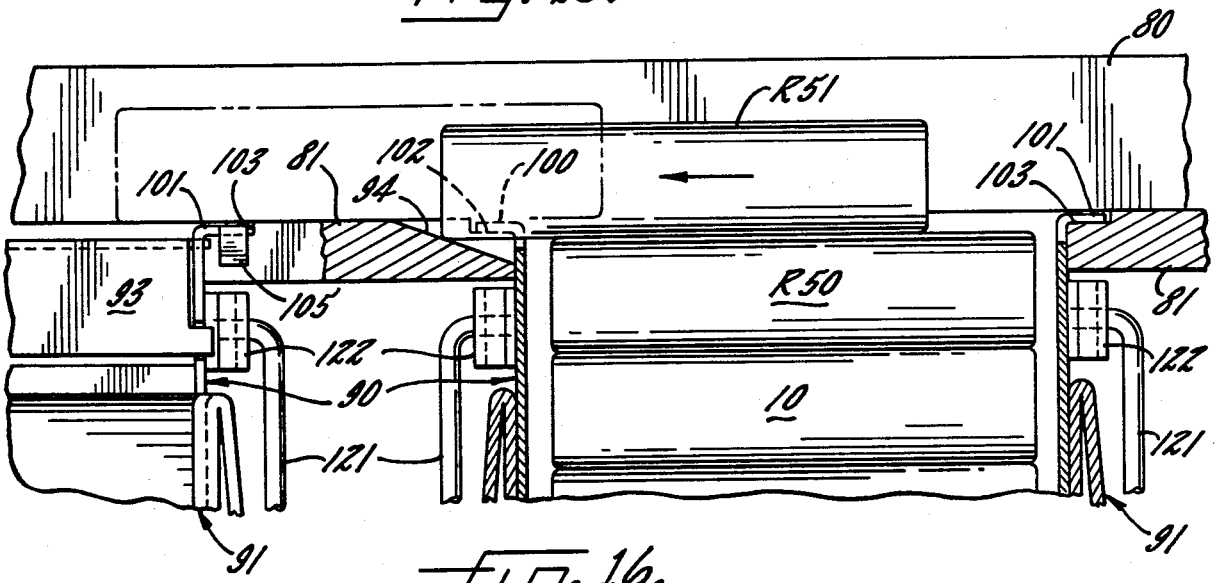

FIG. 16 is a section taken along line 16—16 in FIG. 14*b;*

Figure 12:
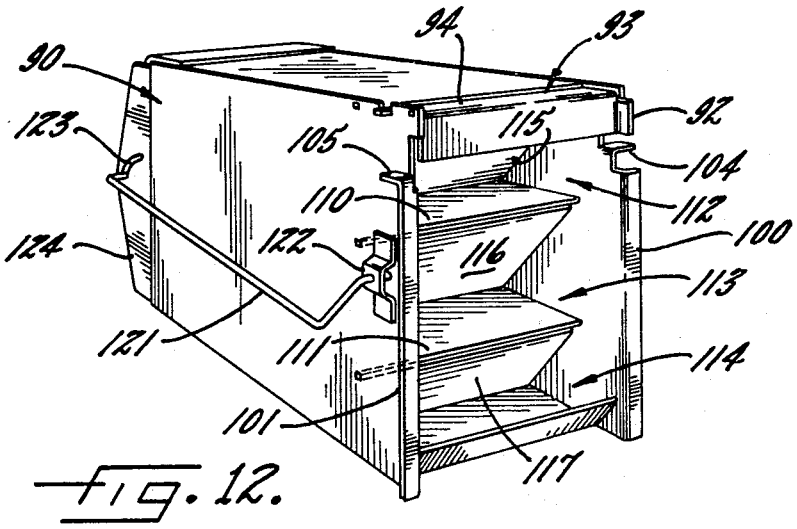
FIG. 12 is a perspective of one of the packaging forms mounted at the four packaging stations illustrated in FIG. 10.
Figure 17:
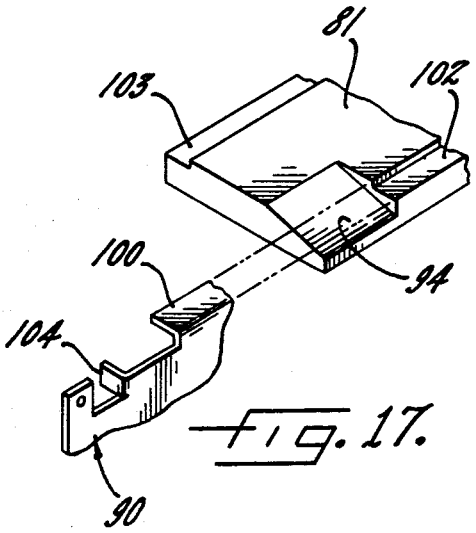
Figure 18:
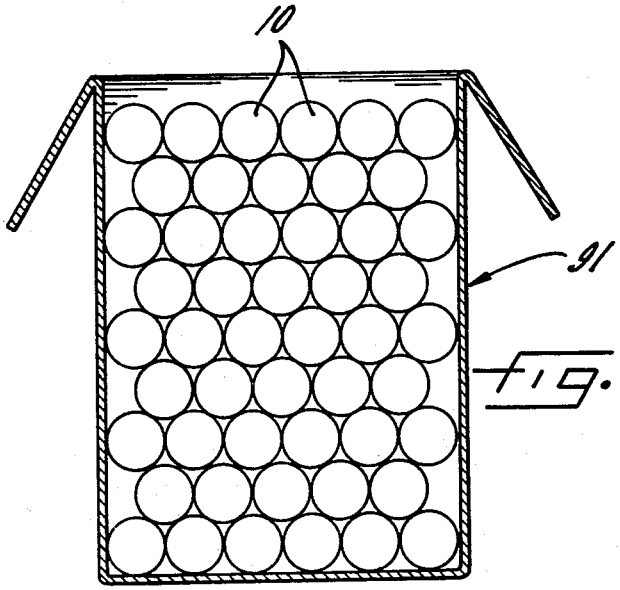
Figure 19A:
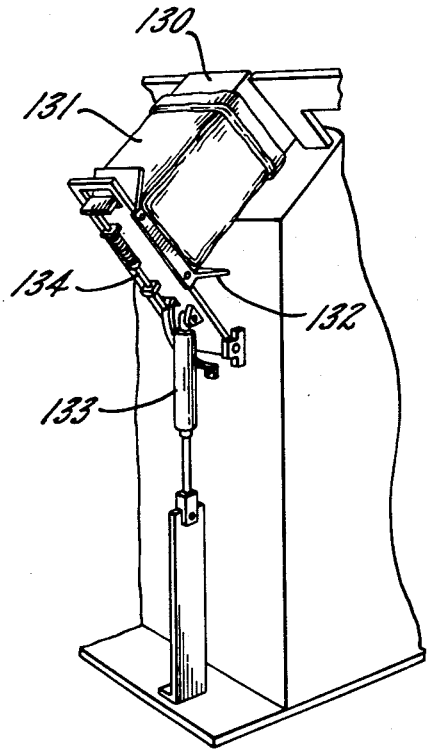
Figure 19B:
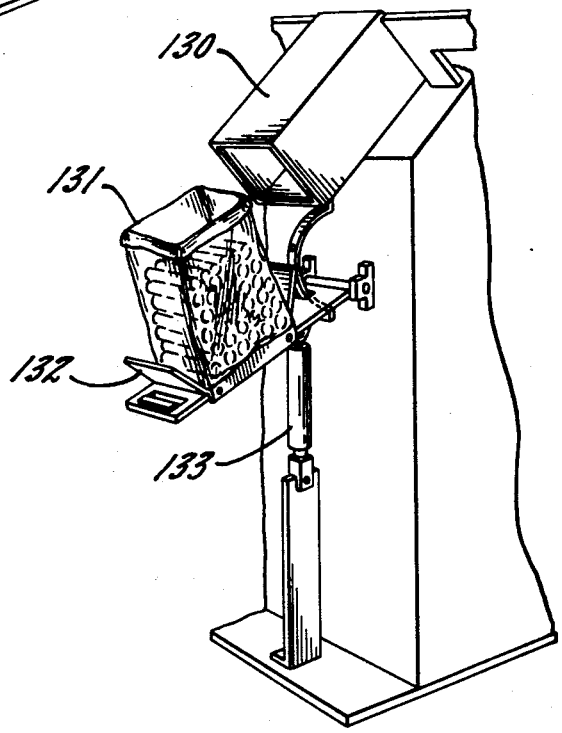

FIG. 17 is an exploded fragmentary perspective view of the upper right-hand corner of the packaging form as illustrated in FIG. 12 and the corresponding portion of the frame on which the packaging form is mounted;

FIG. 18 is a vertical section taken through a box completely filled with coin rolls;

FIG. 19*a* is a fragmentary perspective of a modified form of the illustrative system for packaging the coin rolls in bags rather than boxes; and FIG. 19*b* is a fragmentary perspective of the same system illustrated in FIG. 19*a,* with a filled bag removed from the packaging form.

While the invention will be described in connection with certain preferred embodiments, it will understood that it is not intended to limit the invention to those particular embodiments. On the contrary, it is intended to cover all alternatives, modifications and equivalents as may be included within the spirit and scope of the invention as defined by the appended claims.

Figure 1:
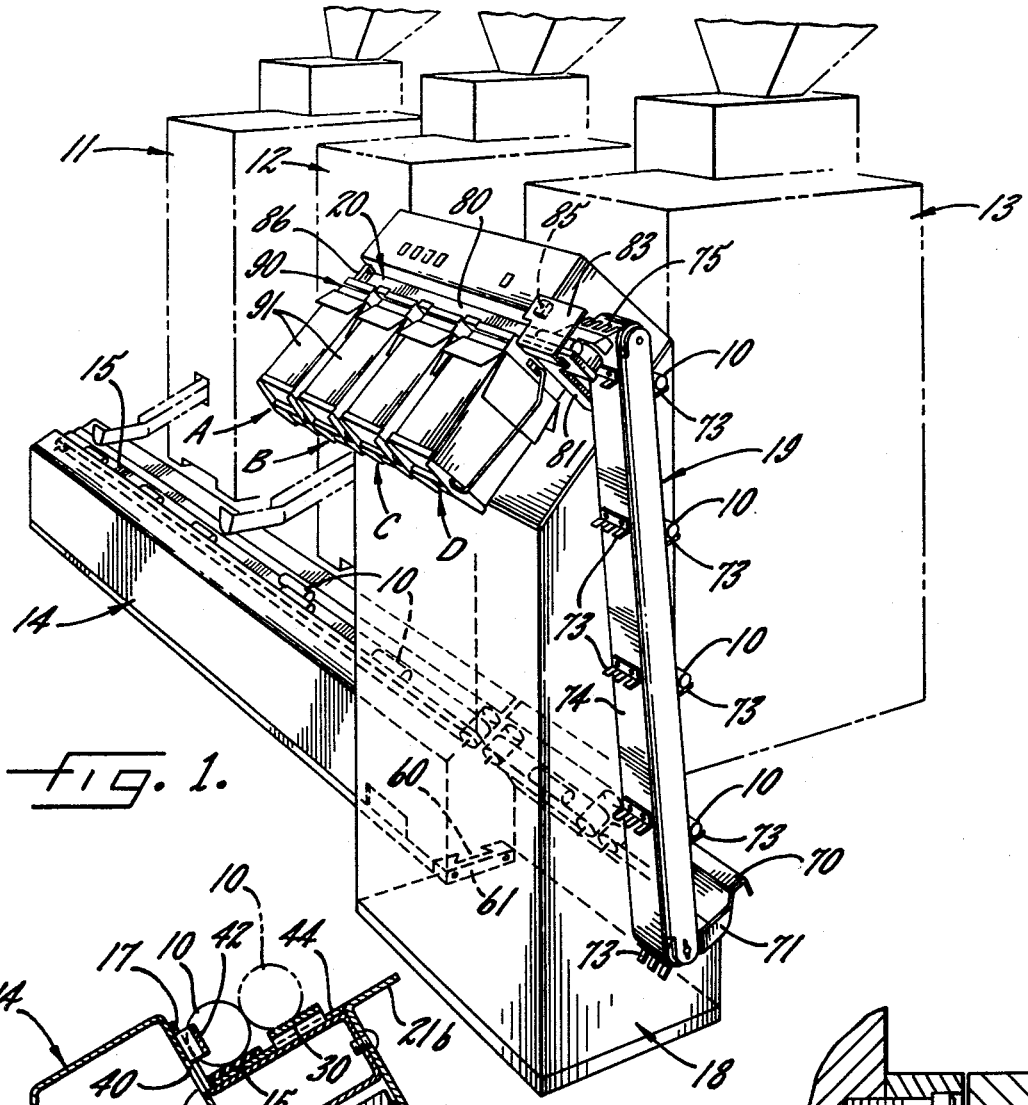
FIG. 1 is a perspective view of a coin roll packaging system embodying the invention, as viewed from the packaging side of the system.
Figure 5:
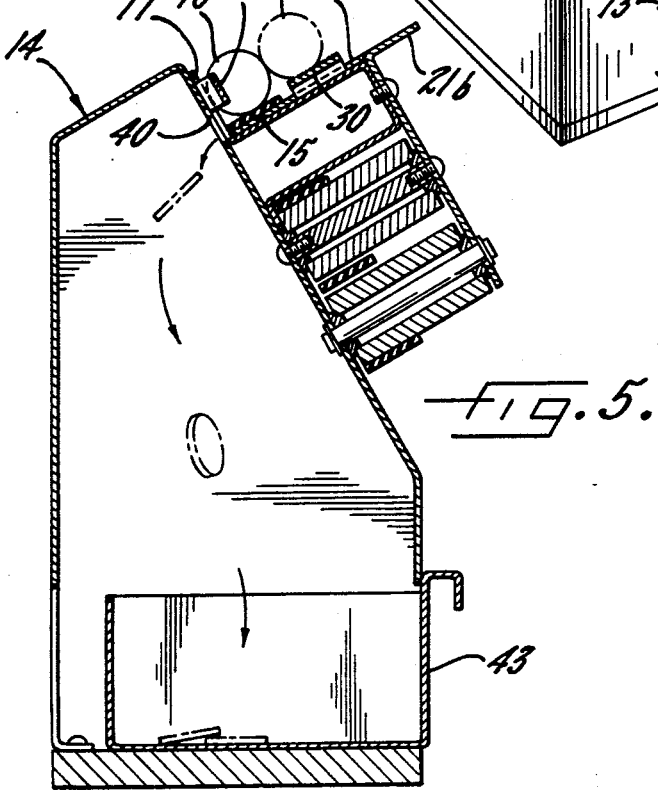
FIG. 5 is a section taken along line 5—5 in FIG. 3.

Turning now to the drawings, and referring first to FIG. 1, there is shown a system for receiving and automatically packaging coin rolls 10 from a line of three coin roll forming and wrapping machines 11, 12 and 13. As the coin rolls 10 are discharged from the machines 11–13, the coin rolls drop onto a conveyor unit 14 which includes a continuous belt 15 driven by a motor 16 and inclined transversely to its direction of movement. A continuous guide rail 17 cooperates with the lower edge of the inclined belt 15 to form a generally V-shaped track along which the coin rolls are conveyed by the driven belt 15, with the V shape of the track bringing the coin rolls 10 into axial alignment with each other so that they are transported along the conveyor unit 14 in seriatim in the direction of the axes of the rolls. From the conveyor unit 14, the coin rolls 10 are transferred to a console 18 which loads the coin rolls onto a lift mechanism 19 for elevating the rolls to an upper conveyor 20 associated with a series of packaging stations A, B, C and D.

Figure 8:
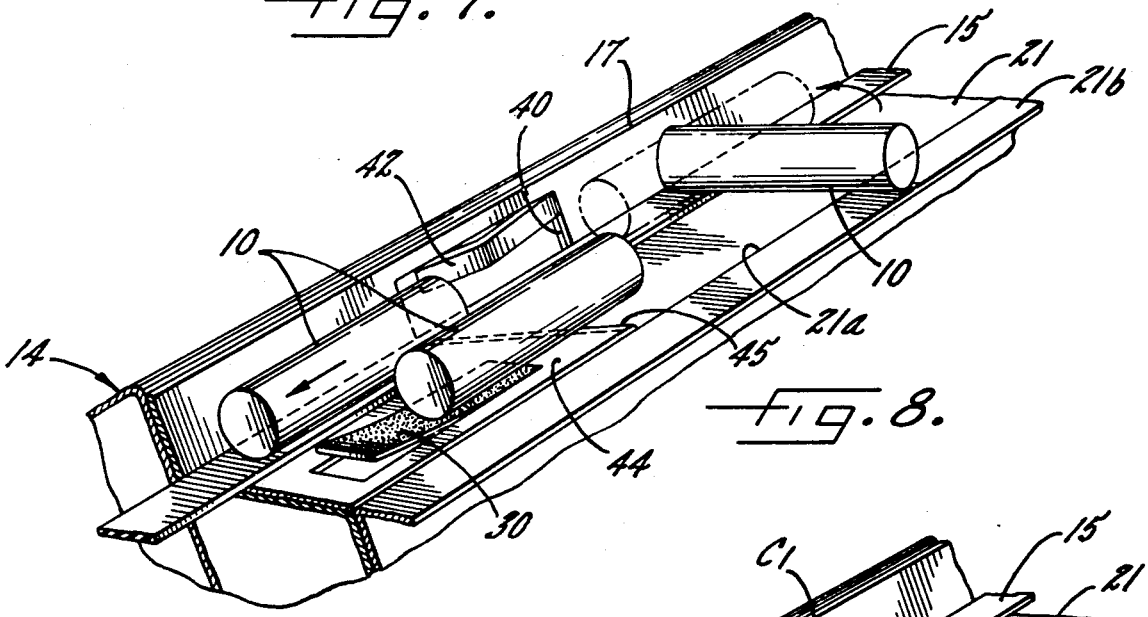
FIG. 8 is an enlarged fragmentary perspective of the same portion of the lower conveyor assembly shown in FIG. 7 and illustrating coin rolls in various possible positions on the conveyor assembly.

In accordance with one aspect of the present invention, the conveyor unit 14 serves to orient the rolls in the direction of their axes, to separate rolls which become lodged on top of each other so that they ride "piggy back" along the conveyor, and to collect any loose coins that drop onto the conveyor unit. Thus, in the illustrative embodiment the V-shaped track tends to orient the coin rolls in the direction of their axes as the rolls are conveyed along the valley of the V by the driven belt 15. The belt 15 is relatively narrow, typically about as wide as one of the coin rolls, and the side wall 21 of the V on which the belt 15 rides is stepped, as at 21*a*, so that any rolls that are deposited transversely on the conveyor are supported only at their ends, as illustrated in FIG. 8. Since one of these two support points is on the driven belt 15, the belt tends to drag any such transverse rolls into line with the belt, so that the rolls fall into the valley of the V-shaped track. In the illustrative embodiment, the stepped side wall 21 of the track is formed by a raised flange 21*b* at the top edge of the belt supporting surface 21 and spaced a substantial distance away from the top edge of the belt 15.

As one specific feature of the invention, friction means are provided on the opposite side of the driven belt from the guide rail for retarding any coin rolls that are overlapping or stacked on top of one another. In the illustrative machine, this friction means is formed by an abrasive-coated tab 30 struck out of the track surface 21 so that any "piggy back" rolls that engage the tab 30 are retarded until a clear space appears between the rolls in the valley of the track so that the retarded roll can roll onto the belt 15. Thus, single file transport of the coin roll is assured.

To collect any loose coins that drop onto the conveyor unit 14, due to roll breakage or a malfunction of one of the wrapping machines, for example, a coin collection slot 40 is formed in the guide rail 17 near the forward end of the conveyor unit 14. Any coins lying on the belt 15 slide through the slot 40 as the belt traverses the slot, and these coins then drop into a collection drawer 43 inserted in the housing of the conveyor unit 14 directly beneath the collection slot 40. These coins can then be periodically retrieved from the drawer 43 and fed into one of the wrapping machines. Of course, the height of the coin collection slot 40 must be shorter than the diameter of the coin rolls to prevent the rolls from becoming hung up on the edges of the slot.

Figure 9:
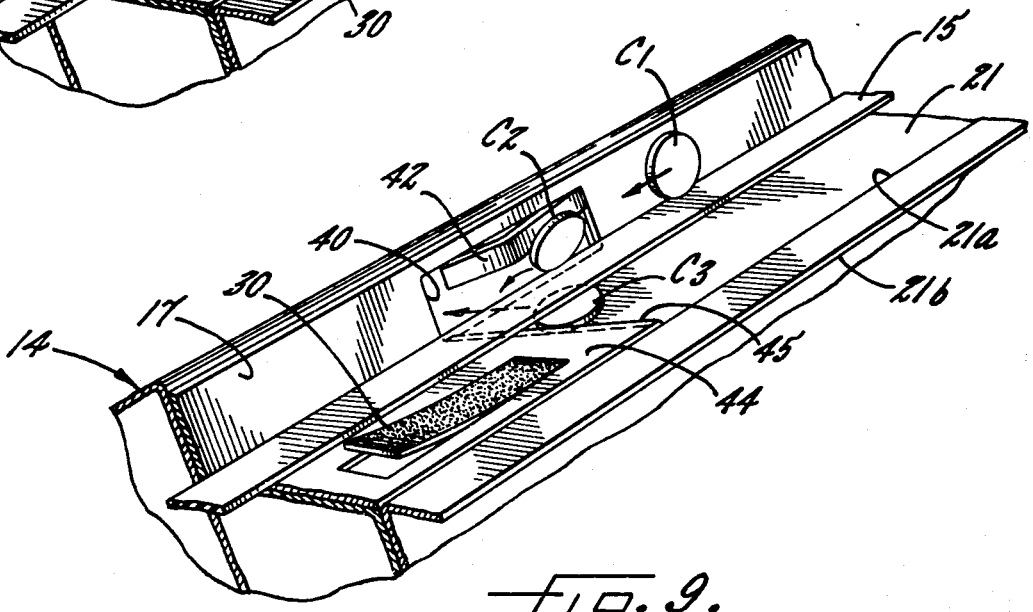
FIG. 9 is a fragmentary perspective of the same portion of the system illustrated in FIG. 8 and illustrating loose coins in various possible positions on the conveyor assembly.

If a loose coin is riding along the guide rail 17 with its edge resting on the belt 15, as illustrated by the coin C1 in the FIG. 9, a kicker bar 42 extending across the top portion of the slot 40 tips over the upstanding coin so that it falls onto the belt 15 and slides through the slot 40 into the drawer 43. The action of the kicker bar 52 is illustrated by the coin C2 in FIG. 9. To collect any coins that happen to become lodged under the belt 15, i.e., between the belt 15 and the track surface 21, such as the coin C3 in FIG. 9, a skimmer plate 44 is fastened to the surface 21 at the forward end thereof. This skimmer plate 44 has a beveled edge 45 which cams any coins lodged under the belt 15 onto the coin collection slot 40, as illustrated by the action of the plate edge 45 on the coin C3 in FIG. 9.

Figure 2:
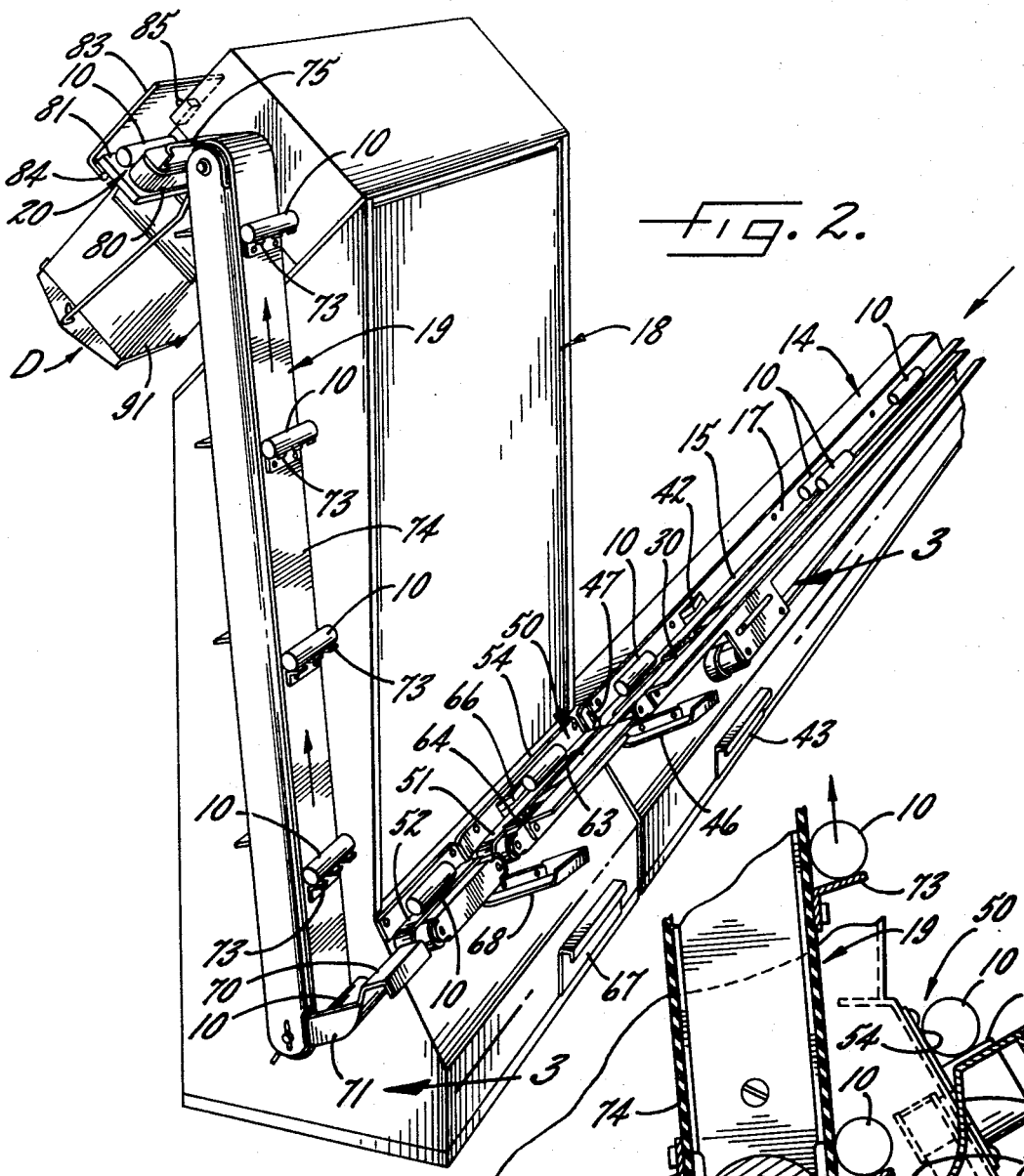
FIG. 2 is a perspective view of the system shown in FIG. 1 from the loading side of the system.
Figure 7:
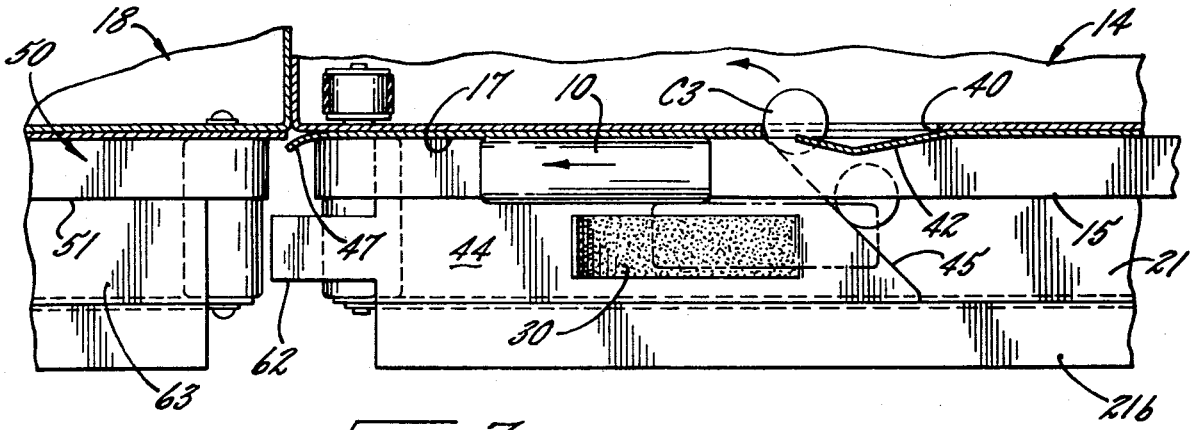
FIG. 7 is an enlarged section taken along line 7—7 in FIG. 3.

In the event that any loose coins bypass the slot 40, or drop onto the conveyor unit downstream of the slot 40, such coins drop off the belt 15 at the forward end of the belt loop and are collected in a chute 46. This chute 46 leads into the coin drawer 43 so that any coins falling into the chute are carried by gravity into the drawer 43 for retrieval along with the coins collected via the slot 40. To ensure that any loose coins riding along the guide rail 17 drop into the chute 46, the forward end of the rail 17 is curled inwardly at 47 (FIG. 2 and 7) to tip any such coins into the chute 46.

In accordance with a further aspect of the invention, the console 18 receives the coin rolls from the conveyor unit 14 on a second continuous belt driven at a speed slower than the main belt 15 for accumulating the coin rolls in closely spaced relation to each other, and a third continuous belt which receives the coin rolls from the second belt is driven at a faster speed than the second belt for separating the coin rolls at substantially uniform intervals for delivery to the lift mechanism 19. Thus, in the illustrative system the coin rolls 10 are fed from the conveyor unit 14 onto a similar V-shaped track 50 at the bottom of the console 18. This track 50 is similar to the V-shaped track formed by the conveyor unit 14, except that the track 50 comprises two tandem belts 51 and 52 driven at different speeds by a motor 53. The first belt 51 is driven at a speed slower than the main belt 15 so that the coin rolls tend to accumulate at closely spaced intervals on the belt 51, and the second belt 52 is driven at about the same speed as the main belt 15 to increase the spacing of the rolls at substantially uniform intervals. Thus, the net effect of the two tandem belts 51 and 52 is to deliver the coin rolls to the lift mechanism 19 at the same rate at which the coin rolls are delivered by the conveyor unit 14, but at a more uniform spacing between successive rolls. Consequently, the coins are delivered to the lift mechanism at about the same rate at which the lift mechanism picks up the rolls from the lower conveyor line.

Figure 4:
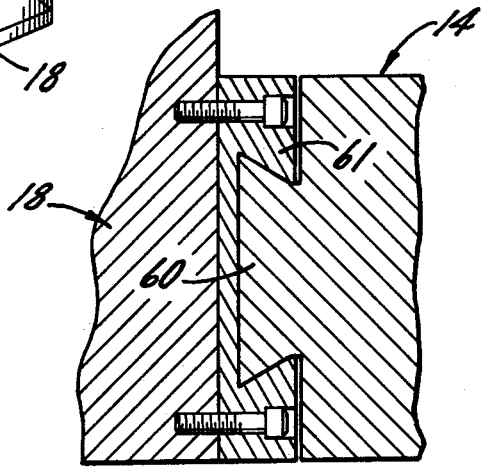
FIG. 4 is an enlarged section taken along line 4—4 in FIG. 3.

As the coin rolls 10 pass from the belt 15 to the belt 51, the curled forward end 47 of the guide rail 17 prevents the rolls from catching on the corner of the console 18. Furthermore, a dovetail connection 60, 61 illustrated in FIG. 4, holds the conveyor unit 14 and the console 18 in rigid alignment with each other to further assure a smooth transfer of the coin rolls from the belt 15 to the belt 51. A tab 62 is also formed on the forward end of the track surface 21 (see FIG. 7) to also assure the smooth transfer of any "piggy back" rolls that manage to get past the abrasive-coated tab 30.

For the purpose of handling any overlapped or stacked coin rolls or any loose coins that enter the lower console conveyor track 50, the console conveyor system includes many of the same features included in the conveyor 14. More specifically, the track surface 63 includes a second abrasive-coated tab 64 to retard any coin rolls that are overlapped or stacked on top of one another. Any loose coins riding on the belt 51 slide through a second coin collection slot 65 into the second coin drawer 67, and a second kicker bar 66 tips over any coins riding along the console guide rail 53, so that these coins fall onto the belt 51 and slide through the slot 65 into drawer 67. At the forward end of the belt 51, a chute 68 receives any remaining loose coins that fall off the forward end of the belt and transport such coins by gravity into the drawer 67.

Figure 6:
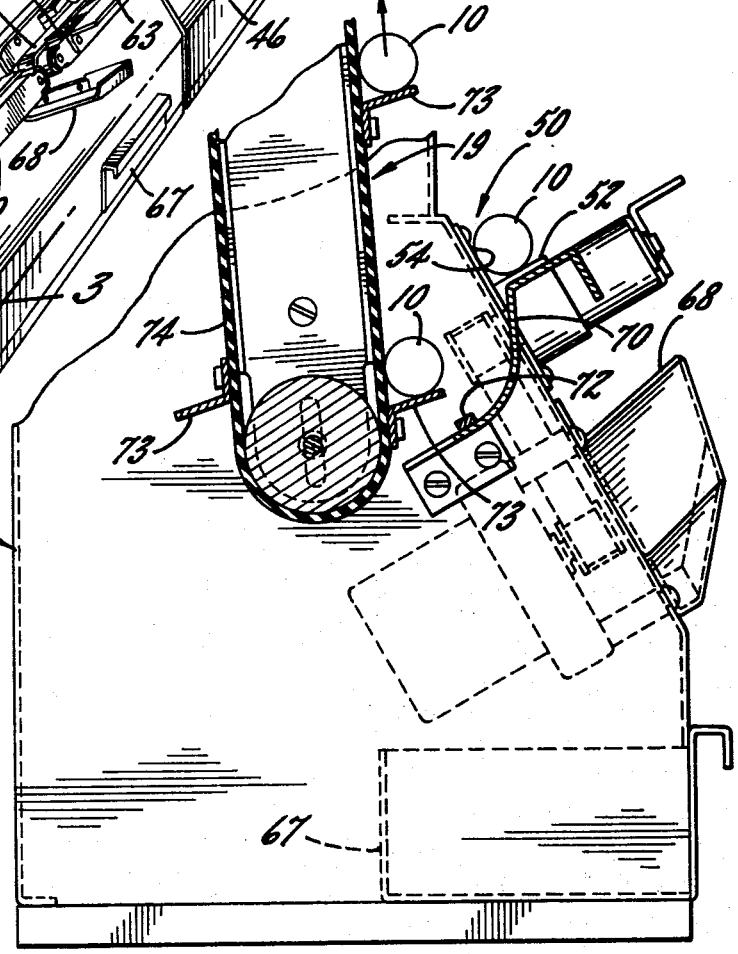
FIG. 6 is an enlarged section taken along line 6—6 in FIG. 3.
Figure 3:
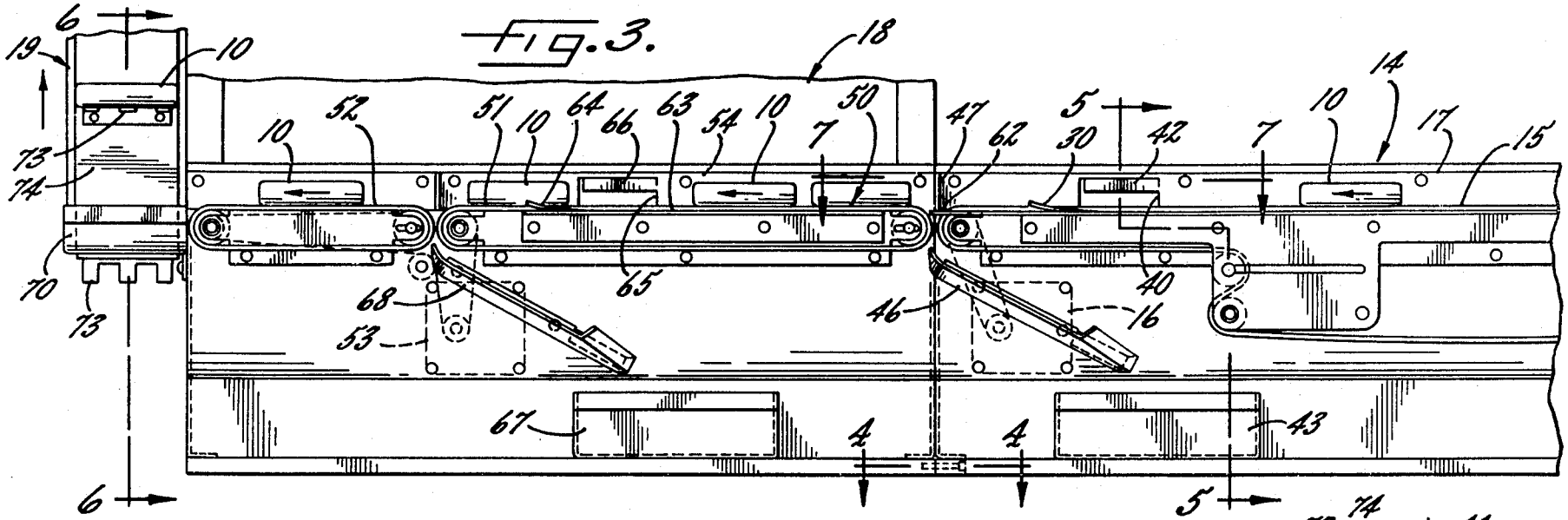
FIG. 3 is an enlarged fragmentary side elevation of the lower conveyor portion of the system of FIG. 1 as viewed from the loading side of the system.

In order to transfer the coin rolls from the final belt 52 to the lift mechanism 19, a transfer plate 70 adjacent the forward end of the belt 52 receives the coin rolls delivered by the belt and guides the rolls downwardly and laterally to the lift mechanism 19. The cavity formed between the transfer plate 70 and the lift mechanism is large enough to accommodate several coin rolls, as can be seen most clearly in FIG. 6, so as to provide a small buffer storage space between the belt 52 and the lift mechanism 19. This buffer storage prevents the coin rolls from spilling onto the floor in the event that the lift mechanism occasionally fails to pick up rolls from the transfer plate 70 at a rate as fast as that at which the rolls are delivered thereto. A raised end wall 71 on the transfer plate 70 prevents any overshooting of rolls that happen to be propelled across the transfer plate 70, thereby providing a further safeguard against the spillage of coin rolls off the machine.

At the lower end of the transfer plate 70, a raised guide bar 72 extending parallel to the track 50 tends to maintain the decending coin rolls in the desired orientation (parallel to the belts 51 and 52) for pick up by the lift mechanism 19. The lift mechanism itself comprises a plurality of sets of fingers 73 carried by an endless vertical belt 74 at uniform intervals. Along the vertical run of the belt 74 adjacent the transfer plate 70, the fingers 73 project laterally from the belt at a slight upward angle. As these fingers 73 traverse the transfer plate 70, they pass through complementary slots formed in the lower edge of the plate 70 so that the fingers repetitively engage and pick up successive coin rolls located at the lower edge of the plate 70. As can be seen most clearly in FIG. 2, the belt 73 is inclined at a slight angle away from the transfer plate 70 so that gravity tends to hold the coin rolls snugly against the belt 74 while they are being elevated thereby.

Figure 10:
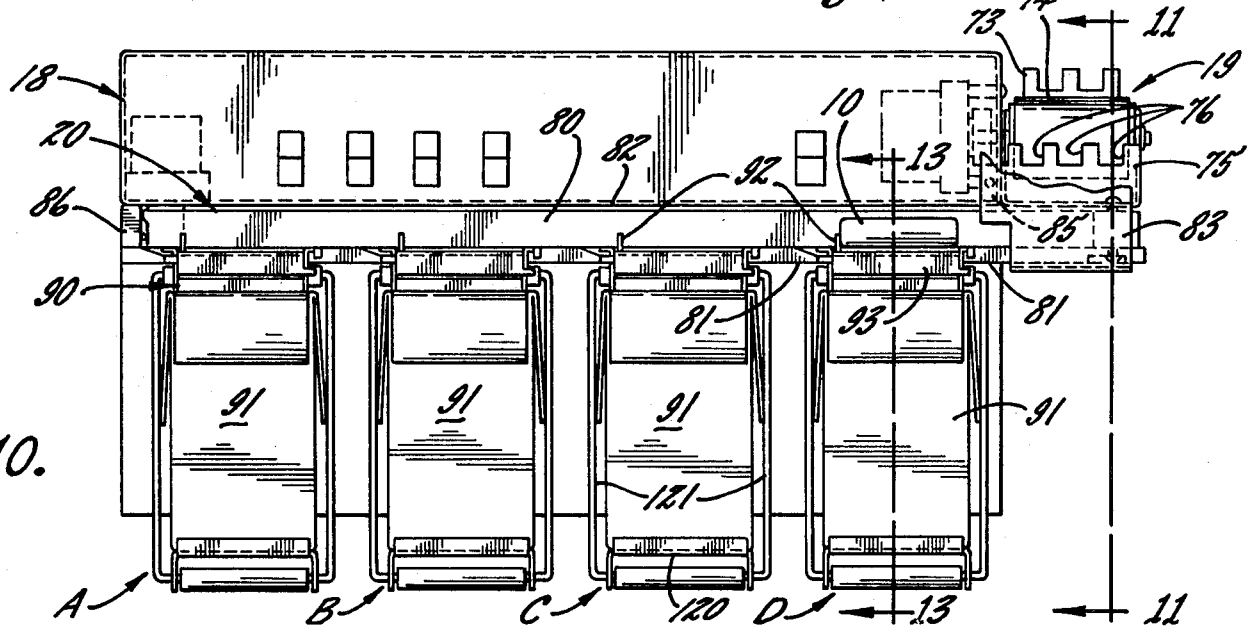
FIG. 10 is a top plan view of the packaging section of the system shown in FIG. 1, taken along line 10—10 in FIG. 11.

When the coin rolls reach the top of the run of the belt 74, the fingers 73 push the rolls onto an inclined pick-off plate 75 forming slots 76 (FIG. 10) which are complementary with the fingers 73. The coin rolls roll downwardly over the pick-off plate 75 onto an upper conveyor belt 80 which is part of an upper V-shaped track defined by a guide rail 81 and an inboard track surface 82. The purpose of this upper conveyor belt 80 is to deliver the coin rolls to the four packaging stations A, B, C and D which are located at a height that makes it convenient for the operator to manually remove and replace each coin roll container as it becomes filled. The belt 80 transports the coin rolls in seriatim along a path parallel to the lower conveyor, but in the opposite direction from the lower conveyor so that the overall size of the machine is relatively compact, because, in effect, the upper conveyor doubles back on the lower conveyor.

Figure 11:
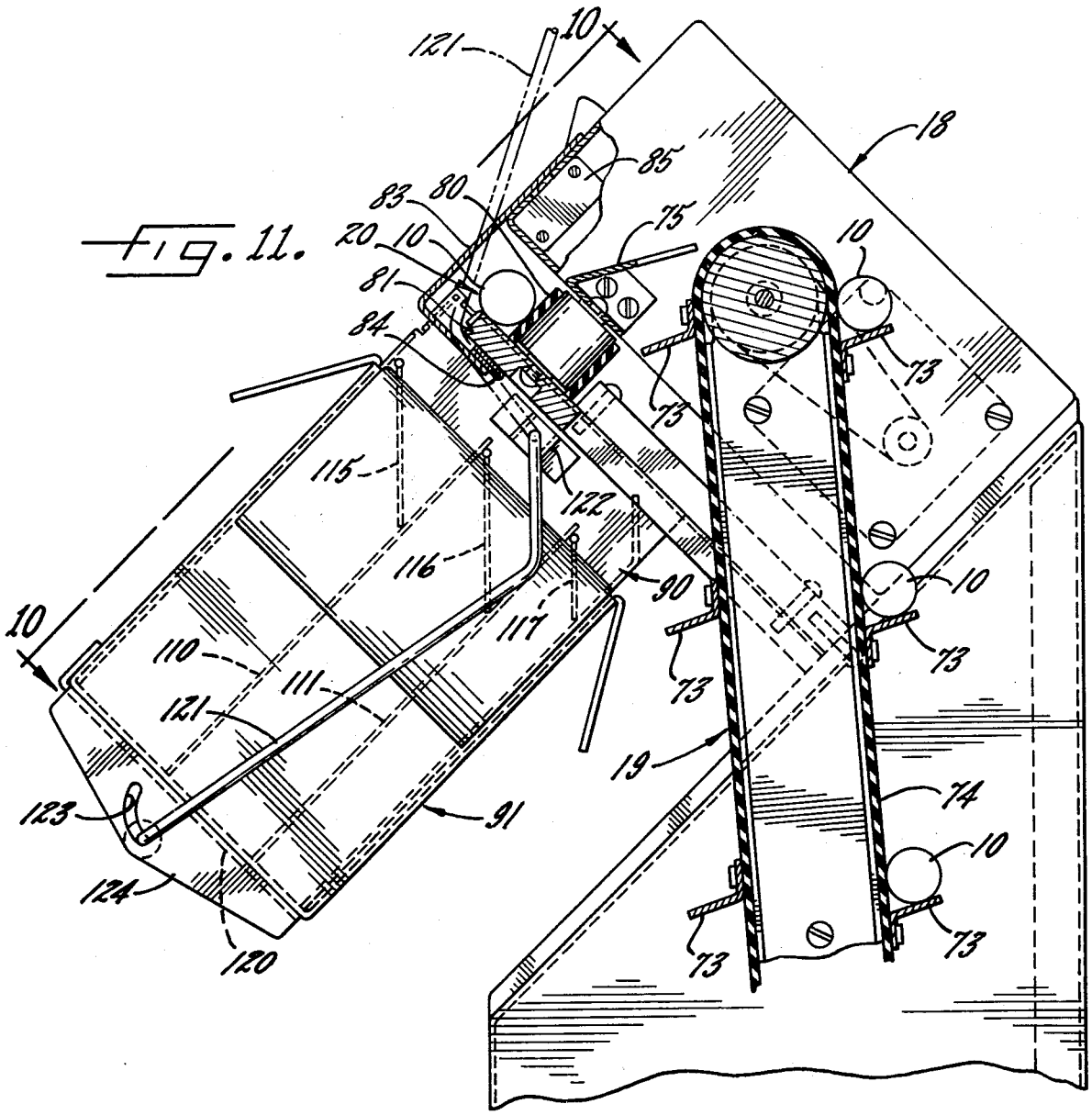
FIG. 11 is an enlarged section taken along line 11—11 in FIG. 10.

As another specific feature of the invention, means are provided for automatically stopping the wrapping machines 11–13 and the entire packaging system in response to an accumulation of coin rolls at the pick-up end of the conveyor belt 80. Such an accumulation of coin rolls might be caused, for example, by a failure of the operator to maintain at least one of the packaging stations A–D free to receive rolls from the belt 80, or by jamming of the coin rolls at the lower end of the pick-off plate 75. If such an accumulation of coin rolls occurs, the rolls cause a cover plate 83 to pivot upwardly about a hinge 84, thereby actuating a limit switch 85 mounted under the top portion of the plate 83 (see FIG. 11) to de-energize the drive motors for the lift mechanism 19 and both the upper and lower conveyors. That is, the cover plate normally depresses the actuator of the limit switch 85 as long as the plate 83 remains in its lowered position, as illustrated in FIG. 11, but upward movement of the cover plate 83 in response to an accumulation of coin rolls thereunder releases the actuator of the limit switch to de-energize the drive motors controlled by that switch.

A second limit switch 86 located at the downstream end of the conveyor 80 also functions to stop the upper conveyor belt 80 and the lift mechanism 19 whenever a coin roll is transported past all four packaging stations, thereby indicating that all stations are full. Thus, the limit switch is located directly in line with the path of the coin rolls on the upper conveyor belt 80, so that a roll which bypasses all four packaging stations A–D strikes the actuator of the limit switch 86 and thereby de-energizes the drive motors for the belt 80 and the lift mechanism 19. Of course, either or both of the limit switches 85 and 86 may also actuate a suitable alarm to alert the operator to the existence of a problem.

As the coin rolls 10 flow along the upper conveyor, they drop into a packaging form 90 at the first available station A, B, C or D. These packaging forms 90 are mounted on the top guide rail 81 adjacent exit openings formed in the guide rail at the four stations. Each of the forms 90 is designed to fit inside a coin roll box 91 and to releasably hold the box 91 on the form 90, with the form 90 extending downwardly at an angle of about 45° so that the coin rolls can be loaded therein by gravity. Since the packaging forms 90 are all identical to each other, and are all mounted on the guide rail 81 in exactly the same manner, only one of the packaging stations will be described in detail herein.

To ensure that the rolls enter the first available station, a pick-off tab 92 projects upwardly from a gate 93 into the path of the rolls on the belt 80 to prevent the rolls from bypassing an available station. The gate 93 is pivoted at the uppermost corner of the packaging form 90 and swings inwardly in response to the weight of each entering coin roll. However, the biasing force exerted on the entering roll by the gate 93 tends to maintain the roll parallel to the belt 80 and, therefore, parallel to the other coin rolls within the form 90. Up until the time the last roll enters the form 90, the gate 93 returns to its normal position as illustrated in FIGS. 13 and **14*a* each time it is cleared by an entering roll. This return movement of the gate 93 occurs quickly enough to position the pick-off tab 92 in the roll path before the next roll passes the packaging station, so that all the rolls on the belt 80** normally enter the first available packaging station until that station is filled.

In accordance with another important aspect of this invention, the relationship between the upper conveyor and each packaging station is such that the last coin roll at a completely filled packaging station is positioned to shunt all succeeding coin rolls to the next packaging station. Thus, as illustrated most clearly in FIG. **14*b*, upon entry of the last coin roll (the 50th roll in the example illustrated in the drawings) the gate 93 is held in a permanently open position by the last roll R50. Furthermore, this last roll is only slightly offset from the surface of the guide rail 81 so that the roll R50 itself serves as a guide surface to bypass all succeeding coin rolls to the next packaging station. As shown in FIGS. 15 and 16, a ramp 94 on the downstream side of each exit opening in the guide rail 81 prevents a roll such as R51 from catching on the edge of the rail 81** during a bypass effected by the roll R50.

When the operator removes the filled box 91 from the packaging form 90, the gate 93 is manually rotated 90° from its normal closed position, i.e., to the position illustrated in FIG. 14*c* so that the second leg 94 of the gate replaces the last packaged coin roll R50 as a shunting means. That is, all succeeding coin rolls, such as the roll R52 illustrated in FIG. 14*c*, ride along the gate leg 94 to bypass the disabled packaging station. During this time, of course, the operator can place a fresh container over the form and latch it in place.

As shown most clearly in FIGS. 15–17, the packaging form 90 is mounted on the guide rail 81 by simply sliding a pair of out-turned flanges 100 and 101 on the top edge of the form downwardly over a pair of complementary grooves 102 and 103 formed in the guard rail 81 along opposite edges of the roll exit opening at each packaging station. When the form 90 is fully advanced to the desired position relative to the guide rail 81, a pair of tabs 104 and 105 (FIGS. 12 and 15) on opposite sides of the form engage the top surface of the guard rail 81 to positively stop the form in the desired position as illustrated in FIG. 11.

As shown most clearly in FIGS. 11–13, the interior of the packaging form 90 is provided with two partitions 110 and 111 which divide the interior of the container into three parallel spaced 112, 113 and 114. The two upper spaces 112 and 113 are dimensioned to accommodate two rows of coin rolls, while the lower space 114 is dimensioned to accommodate only a single row of coin rolls. This partitioning of the interior space of the packaging container helps to guide the coin rolls into the container in a plurality of parallel stacks to that the system will consistently package the same number of rows in each container. The illustrative packaging form 90 also includes hinged biasing plates 115, 116 and 117 at the upper end of each internal space to assist in maintaining the entering coin rolls parallel to each other. When the filled box is removed from the packaging form 90, the parallel rolls settle into a stable nested arrangement as illustrated in FIG. 18.

To removably fasten the coin roll box 91 to the packaging form 90, the form 90 is provided with a movable end plate 120 adapted to fit against the bottom of the box and hold it in its advanced position telescoped over the packaging form 90. The end plate 120 is held against the box by means of a pair of pivotable spring clips 121 each of which has one end journalled in a bracket 122 near the top of the form 90, and the other end slidably received in an arcuate slot 123 formed in a depending flange 124 formed as a part of the end plate 120. When the movable end of the spring clip 121 is at one end of the arcuate slot 123, as illustrated in FIGS. 11 and 12, the end plate 120 is latched firmly against the bottom of the box 91. When the spring clip is moved to the other end of the arcuate slot 123, the end plate 120 is free to be pivoted to a position clear of the box, as illustrated by the broken lines in FIG. 11, so that the box can be removed from the packaging form. Of course, the process is reversed in loading a box onto the packaging form.

An alternative packaging mechanism which is preferred when the rolls are to be packaged in bags rather than in boxes is illustrated in FIGS. 19*a* and 19*b*. In this arrangement, the packaging form comprises a simple rectangular tube 130 without any internal partitions or biasing plates, although it is preferred to still retain the gate at the upper corner of the form for shunting purposes. The bag 131 is simply slipped over the form 130, after which a support plate 132 connected to a hydraulic cylinder 133 is pivoted upwardly against the bottom of the bag 131. When the support plate 132 is in its raised position against the bag 131, a latch 134 is actuated to hold the support 132 in the raised position. When the bag 131 has been filled, the latch 134 is released so that the support plate 132 can be lowered with the filled bag supported thereon, as illustrated in FIG. 19*b*. The hydraulic assist provided by the cylinder 133 is particularly valuable in assisting the operator in supporting the weight of the coin rolls in the bag 130 during the filling and removal operations.

I claim:

1. An automatic packaging system for coin rolls formed by wrapping machines, said system comprising the combination of a. lower conveyor means for receiving coin rolls from a plurality of wrapping machines and transporting the rolls in seriatim in the direction of the axes of the rolls, b. a first transfer mechanism for removing the rolls from the lower conveyor means and transferring the rolls laterally away from the lower conveyor means to a lift station while maintaining the axes of the rolls parallel to each other, c. a vertical lift mechanism for transporting the rolls vertically from the lift station to a packaging station while maintaining the axes of the rolls parallel to each other, d. a second transfer mechanism at the packaging station for transferring the rolls laterally away from the lift mechanism, e. upper conveyor means at the packaging station for receiving coin rolls from the second transfer mechanism and transporting the rolls in seriatim in the direction of the axes of the rolls and opposite the direction of roll movement on the lower conveyor means, f. and means for supporting a plurality of containers adjacent the upper conveyor means with the bottom walls of the containers extending downwardly away from the upper conveyor means to permit the coin rolls to be loaded therein by gravity.

2. An automatic coin roll packaging system as set forth in claim 1 wherein the first transfer mechanism transfers the rolls laterally away from the conveyor means along a path that is perpendicular to the row of rolls on the conveyor means.

3. An automatic coin roll packaging system as set forth in claim 1 wherein the first transfer mechanism transfers the rolls by gravity.

4. An automatic coin roll packaging system as set forth in claim 1 wherein the conveyor means comprises a main driven continuous belt which is inclined transversely to its direction of movement, with a continuous guide rail cooperating with the lower portion of the belt to form a generally V-shaped track along which the coin rolls are conveyed by the driven belt, the V-shape of the track bringing the coin rolls into axial alignment with each other.

5. An automatic coin roll packaging system as set forth in claim 4 wherein the guide rail forms at least one coin slot for discharging any loose coins that fall onto the track so that the loose coins are not carried along with the coin rolls.

6. An automatic coin roll packaging system as set forth in claim 5 which includes a kicker bar associated with said coin slot for tipping over any upstanding coins so that the coins drop through the coin slot when aligned therewith.

7. An automatic coin roll packaging system as set forth in claim 5 which includes a coin skimming surface associated with said coin slot and underlying said belt for guiding any coins stuck under said belt into said coin slot.

8. An automatic coin roll packaging system as set forth in claim 5 which includes a coin collection container below the coin slot for collecting the discharged coins.

9. An automatic coin roll packaging system as set forth in claim 4 which includes friction means on the opposite side of said belt from said guide rail for retarding any rolls that are overlapping or stacked on top of one another.

10. An automatic coin roll packaging system as set forth in claim 4 which includes a second continuous belt in series with the main belt and driven at a speed slower than the main belt for accumulating the coin rolls in closely spaced relation to each other, and a third continuous belt in series with the second belt and driven at a faster speed than the second belt for separating the coil rolls at substantially uniform intervals in the machine direction.

11. An automatic coin roll packaging system as set forth in claim 4 which includes a coin collection chute beneath the forward end of said main belt for collecting any loose coins transported to the forward end of said main belt.

12. An automatic coin roll packaging system as set forth in claim 4 which includes an elevated surface extending parallel to said main belt and spaced laterally therefrom so that any coin rolls turned transverse to the direction of belt movement are supported only at the ends of the rolls with one end of each roll resting on the belt so that the belt tends to pull any transversely turned rolls into axial alignment with the belt.

13. An automatic coin roll packaging system as set forth in claim 1 wherein the rolls are transferred laterally from the upper conveyor into a container in which the rolls are to be packaged.

14. An automatic coin roll packaging system as set forth in claim 1 wherein the upper conveyor comprises a driven continuous belt which is inclined transversely to its direction of movement, with a guide rail cooperating with the lower portion of the belt to from a generally V-shaped track along which the coin rolls are conveyed by the driven belt, said guide rail being interrupted at each packaging station to permit the transfer of coin rolls off the belt.

15. An automatic packaging system for coin rolls formed by wrapping machines, said system comprising the combination of a. upper and lower conveyors for transporting coin rolls in seriatim in the direction of the axes of the rolls, the lower conveyor receiving coin rolls from a plurality of wrapping machines and the upper conveyor delivering coil rolls to a plurality of packaging stations each of which includes means for positioning the last coin roll at a completely filled packaging station to shunt all succeeding coin rolls on the lower conveyor to the next packaging station, b. and a lift mechanism for transporting the coil rolls from the lower conveyor to the upper conveyor.

16. An automatic coin roll packaging system as set forth in claim 15 wherein the upper conveyor comprises a driven continuous belt which is inclined transversely to its direction of movement, and a guide rail cooperating with the lower portion of the belt to form a generally V-shaped track along which the coin rolls are conveyed in the direction of their axes by the driven belt, said packaging stations being located on the guide rail side of the conveyor with the guide rail being interrupted at each packaging station to permit the transfer of coin rolls laterally from the conveyor to the packaging stations.

17. An automatic coin roll packaging system as set forth in claim 15 which includes means for transferring the coin rolls from the upper conveyor to the packaging stations by gravity.

18. An automatic coin roll packaging system as set forth in claim 17 wherein the gravity transfer means associated with each packaging station includes a form disposed within a packaging container at the packaging station for guiding the falling coin rolls into a plurality of parallel stacks of rolls within the container.

19. An automatic packaging system for coin rolls formed by wrapping machines, said system comprising the combination of a. a conveyor for transporting coin rolls in seriatim in the direction of the axes of the rolls, and b. a plurality of packaging stations adjacent the conveyor for receiving coin rolls from the conveyor, each packaging station including means for positioning the last coin roll at a completely filled packaging station to shunt all succeeding coin rolls to the next packaging station along the conveyor.

* * * * *